US008006341B2

(12) United States Patent
Merz et al.

(10) Patent No.: US 8,006,341 B2
(45) Date of Patent: Aug. 30, 2011

(54) FLOOR-CLEANING APPLIANCE

(75) Inventors: Juergen Merz, Waiblingen (DE); Melanie Beer, Rudersberg (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/661,418

(22) Filed: Mar. 15, 2010

(65) Prior Publication Data

US 2010/0218323 A1 Sep. 2, 2010

Related U.S. Application Data

(63) Continuation of application No. PCT/EP2008/005258, filed on Jun. 27, 2008.

(30) Foreign Application Priority Data

Sep. 17, 2007 (DE) ..... 10 2007 045 618

(51) Int. Cl.
*A47L 11/40* (2006.01)

(52) U.S. Cl. ..... 15/49.1; 15/50.1; 15/98; 451/350

(58) Field of Classification Search ..... 15/320, 15/49.1, 50.1, 50.2, 50.3, 52.1, 52.2, 98; 451/350–353
See application file for complete search history.

(56) References Cited

U.S. PATENT DOCUMENTS

| | | | | |
|---|---|---|---|---|
| 1,878,901 | A | 9/1932 | Smellie | |
| 1,909,338 | A * | 5/1933 | Dulin | 15/49.1 |
| 2,039,903 | A * | 5/1936 | Hild | 15/180 |
| 2,142,697 | A * | 1/1939 | Myers | 15/49.1 |
| 2,348,268 | A * | 5/1944 | Smith | 15/49.1 |
| 2,675,246 | A * | 4/1954 | Arones | 280/43.17 |
| 2,949,619 | A * | 8/1960 | Holt | 15/49.1 |
| 3,921,244 | A | 11/1975 | Warren et al. | |
| 4,115,890 | A * | 9/1978 | Burgoon | 15/49.1 |
| 4,658,459 | A * | 4/1987 | Wood | 15/49.1 |
| 5,791,004 | A | 8/1998 | Hammadi | |
| 6,311,356 | B1 | 11/2001 | Wang | |
| 2002/0185907 | A1 | 12/2002 | Zimet | |
| 2003/0056317 | A1 | 3/2003 | Merck | |
| 2007/0029870 | A1 | 2/2007 | Smith et al. | |

FOREIGN PATENT DOCUMENTS

| | | |
|---|---|---|
| DE | 42 09 282 | 10/1993 |
| DE | 20 2004 002 765 | 8/2004 |
| DE | 10 2005 014 583 | 9/2006 |
| DE | 10 2005 037 952 | 2/2007 |
| EP | 1 354 548 | 10/2003 |
| JP | 5-115400 | * 5/1993 |
| WO | 2007/025175 | 3/2007 |

* cited by examiner

*Primary Examiner* — Mark Spisich
(74) *Attorney, Agent, or Firm* — Lipsitz & McAllister, LLC

(57) ABSTRACT

The invention relates to a floor-cleaning appliance having a housing, on the underside of which is disposed at least one floor-cleaning tool adapted to be driven in rotation or oscillation, wherein the floor-cleaning appliance, for the purpose of cleaning a floor surface, can be guided manually by the user in an operating direction along the floor surface. In order to develop the floor-cleaning appliance such that it can be transported in a simple manner, it is proposed according to the invention that the floor-cleaning appliance has transporting wheels which are adapted to be rotatably fixed by the user, for the purpose of transporting the floor-cleaning appliance, on wheel bearings disposed on the side of the housing.

22 Claims, 8 Drawing Sheets

FLOOR-CLEANING APPLIANCE

This application is a continuation of international application number PCT/EP2008/005258 filed on Jun. 27, 2008 and claims the benefit of German application no. 10 2007 045 618.4 filed on Sep. 17, 2007.

The present disclosure relates to the subject matter disclosed in international application number PCT/EP2008/005258 of Jun. 27, 2008 and German application number 10 2007 045 618.4 of Sep. 17, 2007, which are incorporated herein by reference in their entirety and for all purposes.

BACKGROUND OF THE INVENTION

The invention relates to a floor-cleaning appliance having a housing, on the underside of which is disposed at least one floor-cleaning tool adapted to be driven in rotation or oscillation, wherein the floor-cleaning appliance, for the purpose of cleaning a floor surface, can be guided manually by the user in an operating direction along the floor surface.

Such floor-cleaning appliances are used, for example, for scrubbing or polishing a floor surface. For the purpose of cleaning the floor surface, they are guided by the user in an operating direction along the floor surface. If the floor-cleaning appliances are to be transported from a first location of use to a second location of use, they have to be carried by the user or they have to be placed on a transporting device. Floor-cleaning appliances with supporting rollers by means of which the appliances can be moved along a floor surface are also known.

It is an object of the present invention to develop a floor-cleaning appliance of the type mentioned in the introduction such that it can be transported in a straightforward manner.

SUMMARY OF THE INVENTION

This object is achieved according to the invention, in the case of a floor-cleaning appliance of the generic type, in that the floor-cleaning appliance has transporting wheels which are adapted to be rotatably fixed by the user, for the purpose of transporting the floor-cleaning appliance, on wheel bearings disposed laterally on the housing.

The floor-cleaning appliance according to the invention has transporting wheels which can be fixed by the user, preferably without any tools, such that they can be rotated, on wheel bearings disposed at the side on the housing, and such that they can be released again at any time, and the user can then move the cleaning appliance, by means of the transporting wheels, along a floor surface. If the floor-cleaning appliance is being used for the purpose of cleaning a floor surface, then the user can remove the transporting wheels, which are not necessary for cleaning, from the wheel bearings and store them at some other location. The transporting wheels are used when the appliance is to be transported.

The transporting wheels can be stored separately from the floor-cleaning appliance. It is advantageous, however, if the floor-cleaning appliance has at least one storage device for the purpose of storing the transporting wheels when the latter are not in use. The storage device may be configured, for example, in the form of a stowage compartment, of a depression or of a pocket. The use of transporting wheels which can be positioned optionally on a wheel bearing or a storage device has the advantage that the floor-cleaning appliance can be rendered highly mobile without there being any need, for this purpose, for high-outlay holder mechanisms for the transporting wheels. The transporting wheels can be stored in a very space-saving manner. The user can fit the transporting wheels straightforwardly—preferably without any tool—at the respectively desired location, namely on a wheel bearing or a storage device.

It is particularly preferred if the at least one storage device is configured as a wheel holder by means of which a transporting wheel can be retained in a non-displaceable manner on the floor-cleaning appliance.

The transporting wheels are preferably formed such that the floor-cleaning appliance can also be transported over steps or stairs by means of the transporting wheels.

In a preferred configuration, the floor-cleaning appliance is adapted to be transferred out of an operating position, which the appliance assumes for the purpose of cleaning the floor surface, into a transporting position, in which the floor-cleaning appliance can be transported, wherein the transporting wheels fixed on the wheel bearings are spaced apart from the floor surface in the operating position of the floor-treating appliance and in contact with the floor surface in the transporting position of the floor-cleaning appliance. The floor-cleaning appliance can be moved back and forth between an operating position and a transporting position. The operating position is assumed by the floor-cleaning appliance for the purpose of cleaning the floor surface. In the operating position, the at least one floor-cleaning tool is in contact with the floor surface. If the floor-cleaning appliance is to be transported, then it can be transferred into a transporting position, in which the transporting wheels fixed on the wheel bearings are in contact with the floor surface, so that the floor-cleaning appliance can be moved by means of the transporting wheels. If the floor-cleaning appliance assumes its operating position, then the wheel bearings are spaced apart from the floor surface such that the transporting wheels fixed on the wheel bearings are not in contact with the floor surface. This has the advantage that the transporting wheels can easily be fixed on the wheel bearings, by the user, in the operating position of the floor-cleaning appliance without the floor-cleaning appliance having to be raised. The fitting of the transporting wheels to the wheel bearings is thus very straightforward and can be carried out by the user, preferably without any tools, within a short period of time.

In a particularly preferred configuration, the floor-cleaning appliance has two transporting wheels, which, for the purpose of transporting the appliance, are adapted to be fixed on sides of the housing that face away from one another such that they can be rotated about a common axis of rotation, and, for transporting, purposes, the floor-cleaning appliance can be pivoted about the common axis of rotation of the transporting wheels. In such a configuration, the floor-cleaning appliance can be moved in the manner of a hand truck by means of the two transporting wheels. The floor-cleaning appliance can be pivoted about the common axis of rotation of the two transporting wheels and can be pivoted from an operating position into a transporting position.

It is particularly advantageous if the common axis of rotation of the transporting wheels is aligned parallel to the operating direction of the appliance. For the purpose of cleaning a floor surface, the floor-cleaning appliance can be moved forward and backward in the operating direction. Should it subsequently need to be transported, then it can be pivoted to the side about the common axis of rotation of the transporting wheels, so that it can subsequently be moved transversely to the operating direction. In relation to the operating direction, the transporting wheels may be disposed on a front side and a rear side of the housing, in which case they are offset in each case in relation to a center axis of the floor-cleaning appliance. The wheel bearings, which each mount one transporting wheel, may be disposed, for example, in a lateral end region of the front side and of the rear side of the housing.

Positioning the transporting wheels at an end region of the front and rear sides of the housing in which the transporting wheels are disposed adjacent to a first longitudinal side has the advantage that the second longitudinal side of the housing, which is located opposite the first longitudinal side, remains unaffected by the transporting wheels. This, in turn, makes it possible for the second longitudinal side to be positioned at a small distance from a wall when an edge region of a floor surface is to be cleaned. The floor-cleaning appliance is thus distinguished by being able to negotiate edges to good effect, that is to say it can be disposed at a very small distance from a wall bounding the floor surface in order to clean that edge portion of the floor surface which is adjacent to the wall.

It is particularly advantageous here if the at least one floor-cleaning tool is offset, in relation to the center axis of the appliance, in the direction away from the common axis of rotation of the transporting wheels. In relation to the center axis of the floor-cleaning appliance, the at least one floor-cleaning tool is thus positioned asymmetrically in that it is at a smaller distance from that longitudinal side of the housing which is remote from the common axis of rotation of the transporting wheels than from the longitudinal side which is directly adjacent to the common axis of rotation of the transporting wheels. This results in the floor-cleaning appliance being able to access edges to particularly good effect, since the distance of the floor-cleaning tool from one longitudinal side can be kept very small.

It is advantageous if impact-protection elements, for example deflecting rollers, preferably with an elastomeric coating, are disposed on that side of the housing which is remote from the common axis of rotation of the transporting wheels. Such impact-protection elements, in particular deflecting rollers which are adapted to be rotated freely about a vertical axis of rotation, have the advantage that the risk of damage to a wall, or even to the floor-cleaning appliance, can be kept very low when the floor-cleaning appliance is being guided along the wall, at an extremely small distance therefrom, in order to clean an edge portion of a floor surface.

For the purpose of guiding the floor-cleaning appliance along the floor surface which is to be cleaned, in an advantageous embodiment, a pivotable pushing frame is provided. It is advantageous here if the floor-cleaning appliance has an arresting member, and the pushing frame, for the purpose of transporting the floor-cleaning appliance, is adapted to be arrested in the vertical position by means of the arresting member. Arresting the pushing frame in the vertical position is advantageous, in particular, when the floor-cleaning appliance can be transported by means of the transporting wheels in the manner of a hand truck, because in this case the pushing frame can also be used for the purpose of steering the floor-cleaning appliance during transportation. Moreover, it may be provided that the floor-cleaning appliance is adapted to be pivoted about the common axis of rotation of the transporting wheels by means of the pushing frame.

Preferably the arresting member is adapted to be moved back and forth between an arresting position and a release position. It is possible here for the arresting member to have associated with it an actuating device, in particular a foot pedal, which is adapted to be actuated by the user for the purpose of arresting the pushing frame.

In order to simplify the handling of the floor-cleaning appliance, it is advantageous if the arresting member is disposed above the common axis of rotation of the transporting wheels. The arresting member may be disposed directly adjacent, for example, to a longitudinal side of the housing, it also being possible for the transporting wheels to be fixed on the front side and the rear side of the housing at a small distance from this longitudinal side. For transporting purposes, the floor-cleaning appliance can then easily be pivoted about the common axis of rotation of the transporting wheels once the pushing frame has been arrested beforehand in the vertical position by means of the arresting member. The arresting member here is easily accessible for the user from the longitudinal side which is adjacent to the common axis of rotation of the transporting wheels.

In order to avoid unintended release of the transporting wheels from the wheel bearings, it is advantageous if a respective fixing device is disposed on the wheel bearings for the purpose of fixing the transporting wheels.

It is advantageous if the transporting wheels each carry an axle stub and the wheel bearings each comprise a bearing bushing which accommodates the axle stub, wherein the axle stubs are adapted to be arrested in an axially non-displaceable manner in the bearing bushing by means of the fixing device. For the purpose of fixing the transporting wheels on the wheel bearings, the respective axle stubs can be plugged into a bearing bushing, and the axle stubs are then retained in a non-displaceable manner on the bearing bushing by means of the fixing device.

The bearing bushings are formed preferably in a central mounting part of the floor-cleaning appliance, the central mounting part holding drive components of the at least one floor-cleaning tool, in particular of the drive motor and its bearing means, and power-transmission elements. The stable central mounting part, which is produced preferably from metal, in particular from an aluminum material, also ensures a stable bearing means for the transporting wheels. This is advantageous, in particular, when steps also have to be negotiated by means of the transporting wheels.

The fixing devices may have, for example, at least one clamping element for the purpose of arresting an axle stub in the bearing bushing. The clamping element may be configured, for example, in the form of a clamping spring, in particular in the form of a wire clip.

It is particularly advantageous if the axle stubs each have an annular groove in which a clamping element engages automatically when the axle stubs are introduced into a bearing bushing. This allows particularly straightforward fixing of the transporting wheels on the wheel bearings. All that is required, for this purpose, is for the user to plug the axle stubs of the transporting wheels into the associated bearing bushing, and the axle stubs are then locked automatically in the bearing bushing. There is thus no need for any tools for the purpose of fixing the transporting wheels at the side on the housing.

In a preferred configuration the fixing device comprises an actuating element for the purpose of releasing the arresting action of the axle stub. This has the advantage that the user can also release the transporting wheels from the wheel bearings without using any tools. All that is required, for this purpose, is for the user to actuate the actuating element, so that the axle stub of the transporting wheel is freed.

The actuating element may be configured, for example, in the form of a pushbutton which can be actuated in order to transfer the clamping element out of a clamping position into a release position. As has already been explained, the clamping element may be, for example, in the form of a wire clip which clamps or latches the axle stub in the bearing bushing. The wire clip can be guided along a sliding surface by means of the pushbutton, whereby it transfers into a release position, so that the axle stub can be removed from the bearing bushing without obstruction.

Nothing more specific has been said up until now in respect of the positioning and configuration of the storage devices on or in which the transporting wheels can advantageously be stored during the cleaning operation of the floor-cleaning appliance. In a preferred configuration, the storage devices are disposed at a distance from the housing, preferably on a pushing frame of the floor-cleaning appliance. This makes it possible for the housing to be of very flat construction, so that the operating height of the floor-cleaning appliance can be kept to a low level.

A particularly space-saving configuration of the floor-cleaning appliance is distinguished in that the floor-cleaning appliance has two storage devices that face away from one another. These may engage directly against one another and be positioned, for example, on a front side and a rear side of a pushing frame. The pushing frame preferably forms a handle which can be gripped by the user, and the two storage devices are disposed on the pushing frame directly beneath the handle.

The storage devices are preferably of shell-like configuration. It is advantageous here if use is made of two shell-like storage devices which can be screw-connected to one another, these advantageously accommodating the pushing frame of the floor-cleaning appliance between them.

As has already been mentioned, it is advantageous if the transporting wheels each carry an axle stub. It is advantageous here if the storage devices are configured as wheel holders which each have a mount into which an axle stub can be plugged.

The axle stubs can advantageously be clamped in the mounts. For this purpose, the mounts may have a plurality of clamping jaws which accommodate an axle stub between them. The clamping jaws may be produced from an elastically deformable material, in particular from a plastics material. It is particularly advantageous if the clamping jaws are connected integrally to a plastics-material wheel holder in the form of a retaining shell. The retaining shells may each form a supporting surface on which a transporting wheel can be supported in the vertical direction. This allows reliable storage of the transporting wheels during the cleaning operation of the floor-cleaning appliance.

At least one floor-cleaning tool is formed preferably as a rotary brush which is mounted such that it can be rotated about an axis of rotation. The floor-cleaning appliance preferably has two rotary brushes.

Moreover, it may be provided that an additional floor-cleaning tool is formed as a suction device.

As an alternative, or in addition, it may be provided that a floor-cleaning tool is configured as a spray device, by means of which a floor surface which is to be cleaned can be sprayed with a cleaning liquid.

In a preferred embodiment, the floor-cleaning appliance is formed as a scrubber dryer. This may have two parallel rotary brushes and a cleaning-liquid tank and a contaminated-liquid tank, wherein cleaning liquid can be applied from the cleaning-liquid tank to the floor surface which is to be cleaned and contaminated cleaning-liquid can be transferred from the floor surface into the contaminated-liquid tank.

It is particularly advantageous if the floor-cleaning appliance has supporting elements, for example supporting rollers or supporting wheels, which are retained on the housing such that they can be adjusted in the vertical direction. This makes it possible for the contact pressure which the floor-cleaning tool applies to the floor surface which is to be cleaned to be adjusted by virtue of the position of the supporting elements being adjusted. If the supporting elements assume a position in which they are spaced apart to the greatest extent available from the floor surface which is to be cleaned, then the at least one floor-cleaning tool can be subjected to the entire weight of the floor-cleaning appliance and can thus apply high contact pressure to the floor surface which is to be cleaned. If, instead, the supporting elements are displaced in the direction of the floor surface, then, during cleaning of the floor surface, they can take up at least some of the weight of the floor-cleaning appliance and thus reduce the contact pressure of the floor-cleaning tool.

It is particularly advantageous if, by virtue of a pushing frame of the floor-cleaning appliance being pivoted into its vertical position, the supporting elements can be displaced downward out of the housing. This makes it possible, in particular, for the at least one floor-cleaning tool to be relieved of loading during storage of the floor-cleaning appliance in that all the weight of the floor-cleaning appliance is carried by the supporting elements in their extended position.

The following description of a particularly preferred embodiment of the invention serves to provide a more specific explanation in conjunction with the drawings.

DETAILED DESCRIPTION OF THE INVENTION

Figure 1:
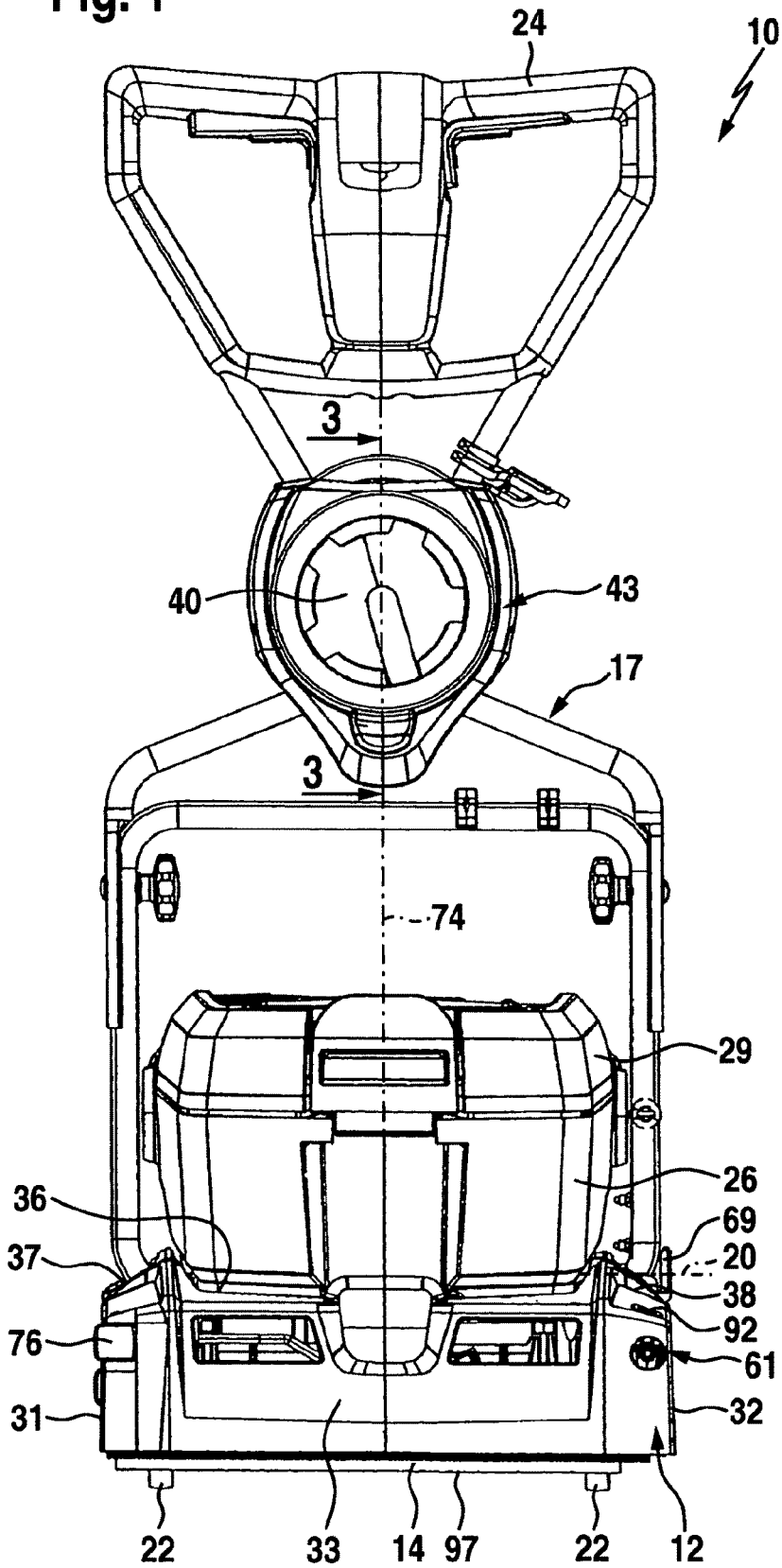
FIG. 1: shows a schematic front view of a floor-cleaning appliance with transporting wheels which, for storage purposes, are retained on wheel holders.
Figure 2:
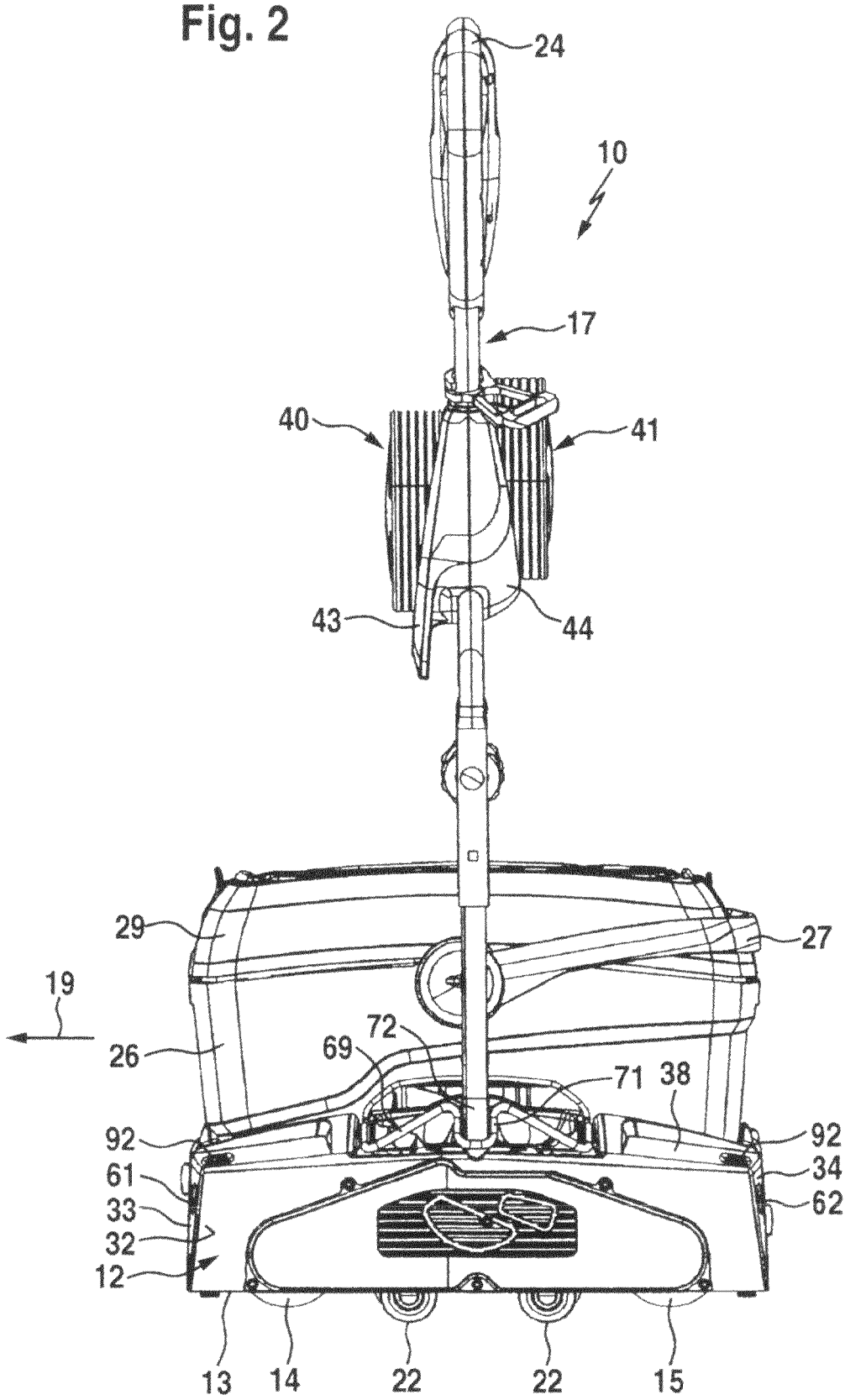
FIG. 2: shows a schematic side view of the floor-cleaning appliance from FIG. 1.
Figure 3:
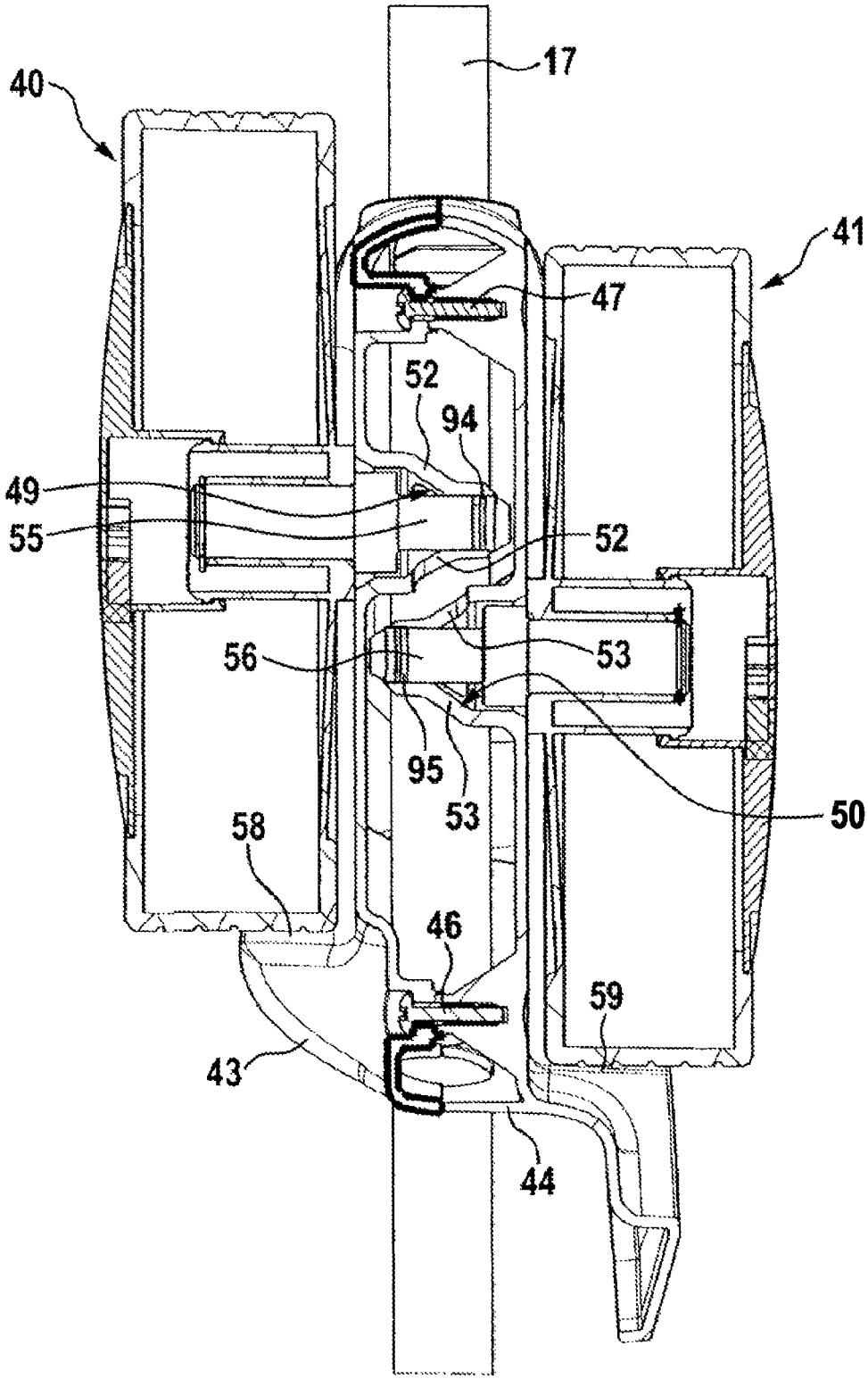
FIG. 3: shows a sectional view along line 3-3 in FIG. 1.

The drawing illustrates, schematically, a floor-cleaning appliance in the form of a scrubber dryer 10 having a housing 12 which forms a chassis and on the underside 13 of which a first floor-cleaning tool in the form of a front rotary brush 14 and a second floor-cleaning tool in the form of a rear rotary brush 15 are rotatably mounted. A pushing frame 17 is mounted on the housing 12 such that it can be pivoted about a pivot axis 20 oriented perpendicularly to an operating direction 19. Within the housing 12, supporting rollers 22 are mounted such that they can be displaced in the vertical direction. The supporting rollers are coupled to the pushing frame 17, via a supporting mechanism which is known per se and is thus not illustrated in the drawing, such that they automatically assume their extended position, which is illustrated in the drawing, as soon as the pushing frame 17 is oriented vertically. If the pushing frame 17 is pivoted out of the vertical, then the supporting rollers 22 assume a retraced position, in which the two rotary brushes 14 and 15 are in contact with a floor surface which is to be cleaned.

The pushing frame 17 forms, at its upper end region, a handle 24 which can be gripped by the user, so that it can be gripped easily for the purpose of guiding the scrubber dryer 10 along a floor surface which is to be cleaned.

A contaminated-water tank 26 with a pivotable carrying handle 27 is disposed on the housing 12, and a clean-water tank 29 is positioned on the contaminated-water tank 26. The clean-water tank 29 can be filled with water, which can be mixed with a cleaning chemical for the purpose of increasing the cleaning action. The clean-water tank 29 is in flow connection in conventional manner via a clean-water line, which to give better clarity has not been illustrated in the drawing, with a spray device which is known per se, cannot be seen from the drawing and is disposed on the underside of the housing 12, so that clean water can be sprayed onto a floor surface which is to be cleaned.

The contaminated-water tank 26 is in flow connection in conventional manner via a contaminated-water line, which to give better clarity has likewise not been illustrated in the drawing, with a suction bar disposed on the underside of the housing 12, and the contaminated-water tank can be subjected to negative pressure by means of a suction subassembly of the scrubber dryer 10. This makes it possible for contaminated water to be picked up from the floor surface which is to be cleaned and transferred into the contaminated-water tank 26. The suction bar and the suction subassembly are known per se and thus have not been illustrated in the drawing.

The housing 12 is substantially cuboidal and has a first longitudinal side 31 and a second longitudinal side 32, which are connected to one another via a front side 33 and a rear side 34. On the top side, the housing 12 has a depression 36 into which the contaminated-water tank 26 is inserted. Laterally alongside the depression 36, the housing 12, adjacent to the first longitudinal side 31 and the second longitudinal side 32, has a respective first edge portion 37 and second edge portion 38, both on the top side.

For the purpose of cleaning a floor surface, the scrubber dryer 10 can be guided by the user along the floor surface in the operating direction 19.

For transporting purposes, the scrubber dryer 10 has two transporting wheels 40, 41 which, during the cleaning operation of the scrubber 10, can each be stored in a storage device. The storage devices, for the purpose of holding the transporting wheels 40, 41 in a non-displaceable manner, are each configured as a wheel holder in the form of a first retaining shell 43 and of a second retaining shell 44. The two retaining shells 43, 44 are disposed on the pushing frame 17 directly beneath the handle 24. The retaining shells 43, 44 face away from one another and are screw-connected to one another by means of connecting screws 46, 47, the pushing frame 17 running between the retaining shells 43, 44.

The retaining shells 43, 44 each have a respective mount 49, 50, and these are each defined by three clamping jaws, respectively 52 and 53, which interact with one another. The clamping jaws 52 and 53 are connected integrally to the respective retaining shell 43, 44 and, like the retaining shells, are themselves produced from an elastically deformable plastics material.

The two transporting wheels 40 and 41 each carry a respective axle stub 55, 56, which can be clamped into a respective mount 49, 50 with elastic deformation of the respective clamping jaws 52 and 53. In this position, the respective transporting wheel 40, 41 is supported in the vertical direction by a respective supporting surface 58, 59 of the retaining shells 43, 44.

Figure 7:
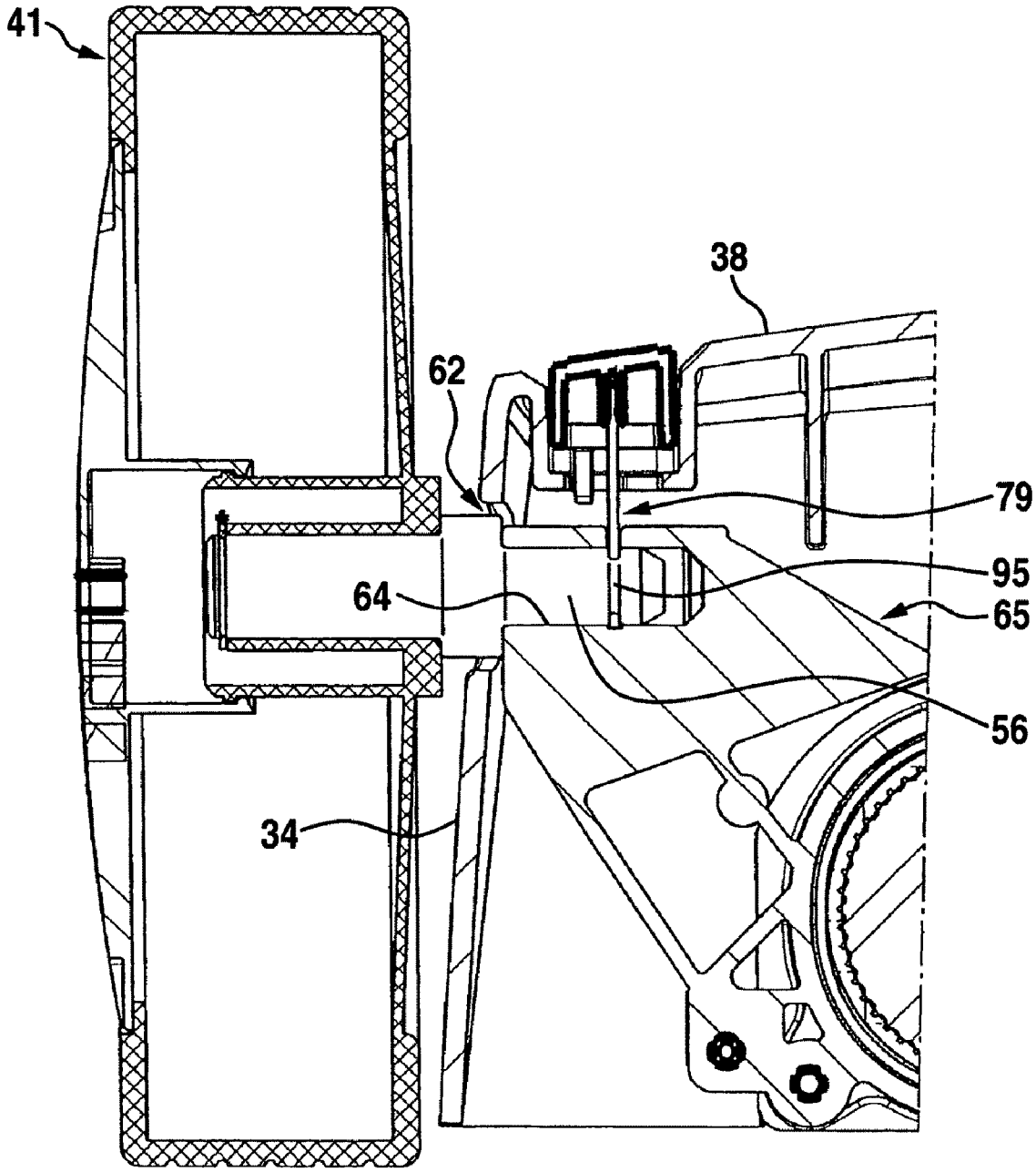
FIG. 7: shows a sectional view along line 7-7 in FIG. 6.

If, following cleaning operation, the scrubber dryer 10 needs to be transported, then the two transporting wheels 40, 41 can be removed from the respective retaining shells 43 and 44 and fixed to respective wheel bearings 61 and 62, so that the scrubber dryer 10 can then be moved around by means of the transporting wheels 40, 41. A first wheel bearing 61 is disposed on the front side 33 of the housing 12, beneath the second edge portion 38, directly adjacent to the second longitudinal side 32, and a second wheel bearing 62 is disposed on the rear side 34, beneath the second edge portion 38, directly adjacent to the second longitudinal side 32. The two wheel bearings 61, 62 are identical. They each have a bearing bushing 64 into which an axle stub 55 or 56 can be plugged. This is evident, in particular, from FIG. 7. The bearing bushings 64 are formed in a central mounting part 65 for the drive components of the scrubber dryer 10, in particular for the drive motor of the rotary brushes 14, 15 and for power-transmission elements. The stability of the mounting part 65, which is produced from an aluminum material, thus also helps to provide a stable bearing means for the transporting wheels 40, 41. This makes it possible for even steps to be negotiated by means of the transporting wheels 40, 41. The considerable weight of the scrubber dryer 10 is consequently taken up safely by the transporting wheels 40, 41.

Figure 8:
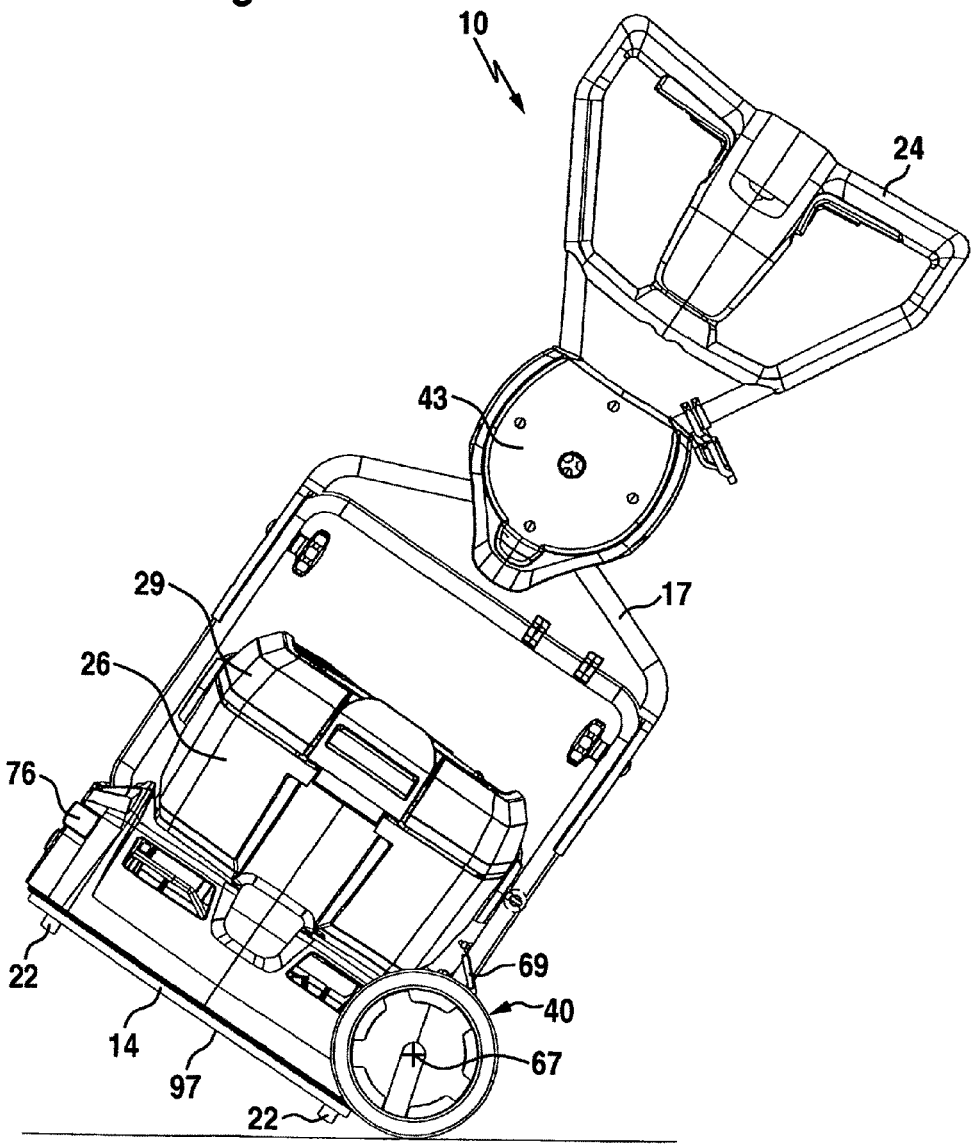
FIG. 8: shows a front view of the floor-cleaning appliance corresponding to FIG. 4, the floor-cleaning appliance assuming a transporting position.

The transporting wheels 40, 41 fixed to the wheel bearings 61, 62 are mounted on the housing 12 such that they can be rotated freely about a common axis of rotation 67. The common axis of rotation 67 is aligned parallel to the operating direction 19. By virtue of being pivoted about the common axis of rotation 67, the scrubber dryer 10 can be pivoted in the manner of a hand truck from the operating position, which is illustrated in FIGS. 1 to 7, into the transporting position, which is illustrated in FIG. 8, so that the scrubber dryer 10 can be moved around by means of the transporting wheels 40, 41.

Figure 4:
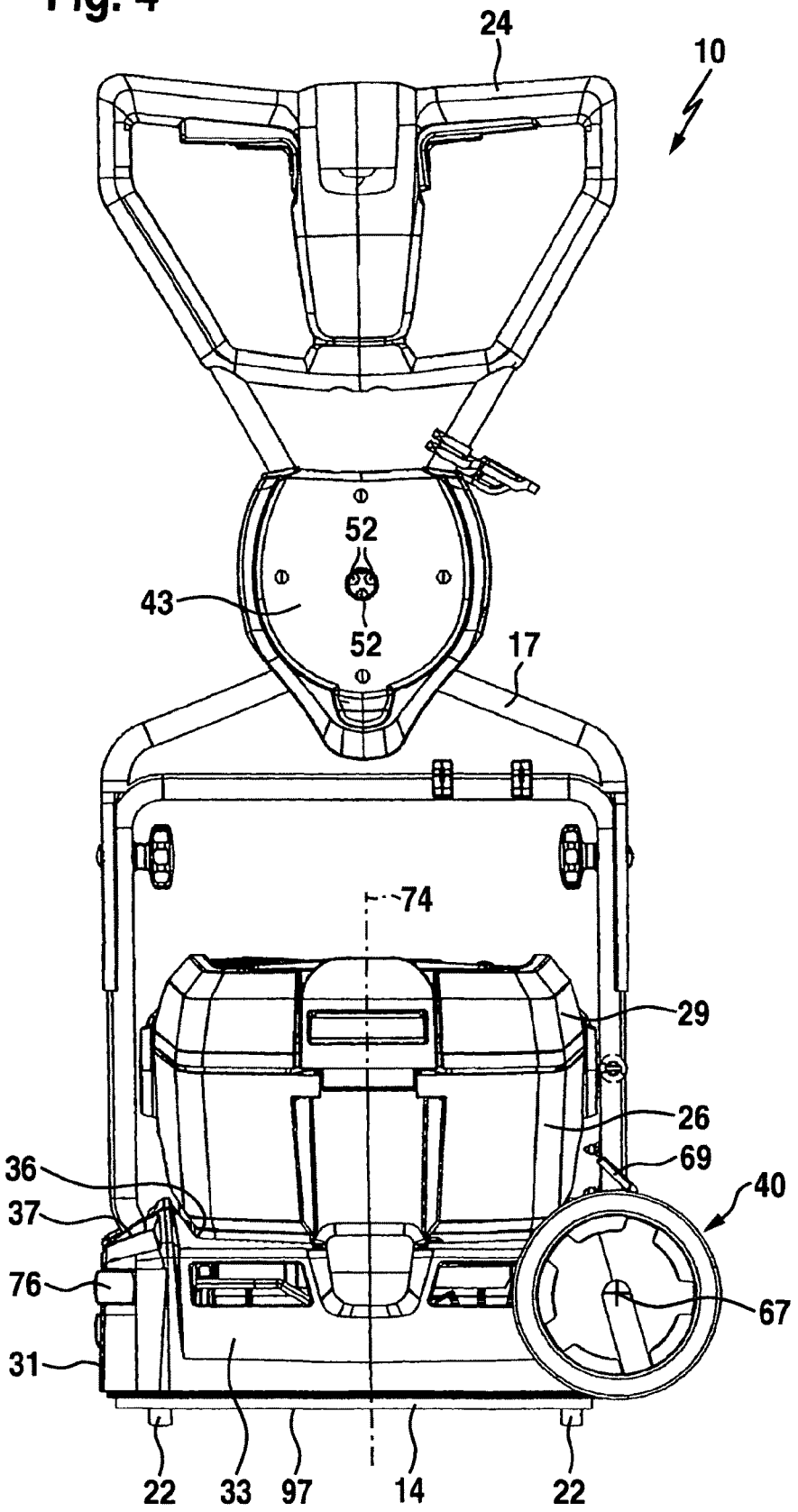
FIG. 4: shows a schematic front view of the floor-cleaning appliance corresponding to FIG. 1, wherein the transporting wheels, for the purpose of transporting the floor-cleaning appliance, are fixed on wheel bearings at the side on a housing of the floor-cleaning appliance.
Figure 5:
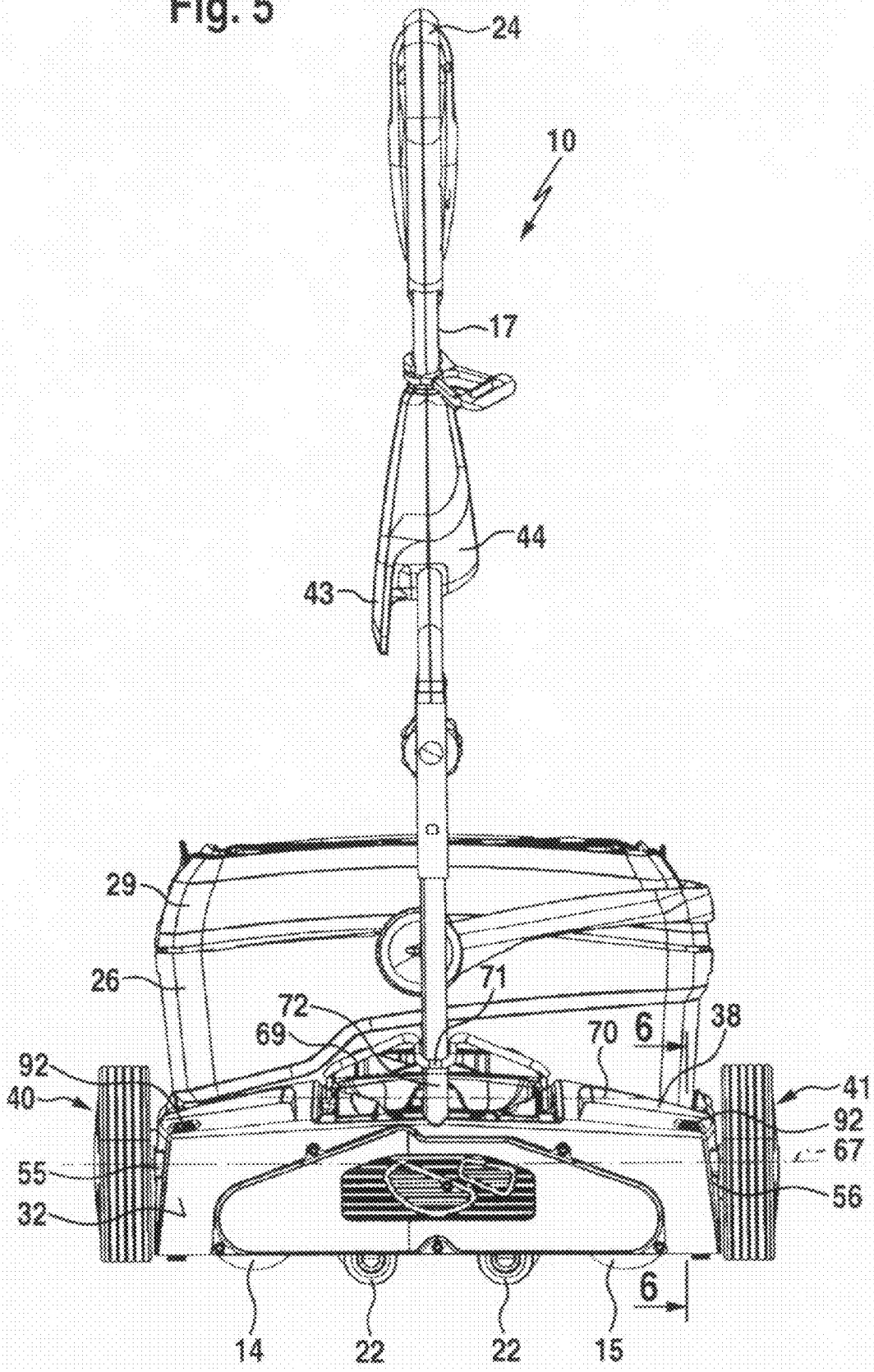
FIG. 5: shows a side view of the floor-cleaning appliance from FIG. 4.
Figure 6:
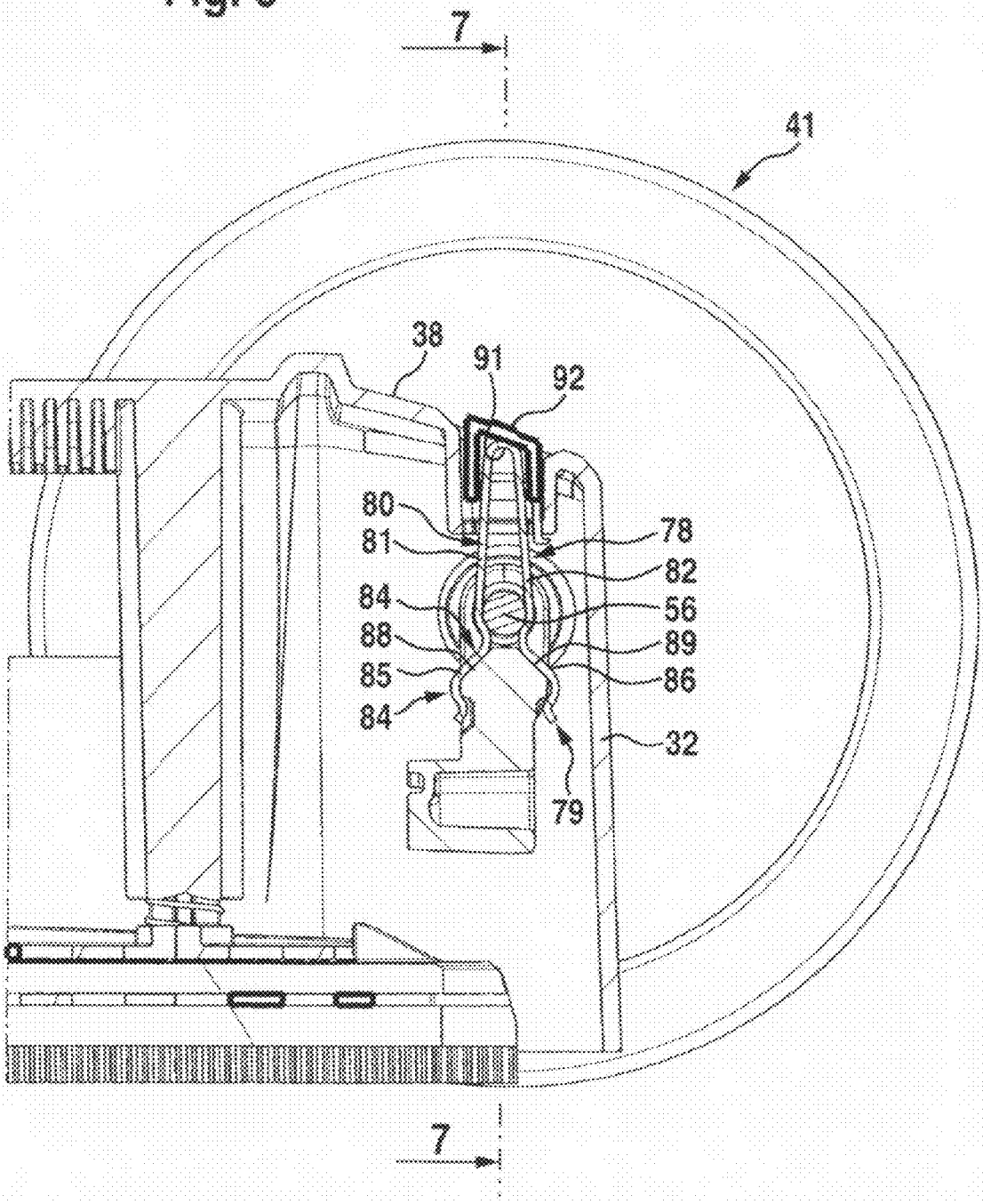
FIG. 6: shows a sectional view along line 6-6 in FIG. 5.

In order to make it easier for the scrubber dryer 10 to be pivoted about the common axis of rotation 67, the pushing frame 17 can be arrested in its vertical position. For this purpose, an arresting member in the form of a wire clip 69 is mounted on the second edge portion 38 of the housing 12 such that it can be pivoted about a pivot axis 70 aligned parallel to the common axis of rotation 67. In an arresting position, which is illustrated in FIGS. 4, 5 and 8, the wire clip 69 engages, by way of a U-shaped arresting portion 71, around a lower end region 72 of the pushing frame 17 and thus secures the same in its vertical position. In a release position of the wire clip 69, this position being illustrated in FIGS. 1 and 2, the arresting portion 71 frees the end region 72 of the pushing frame 17, so that the pushing frame 17 can be pivoted about the pivot axis 20 without obstruction.

The two wheel bearings 61 and 62 are disposed at that end region of the respective front side 33 and rear side 34 which is directed toward the second longitudinal side 32, that is to say they are offset, in relation to the center axis 74 of the scrubber dryer 10, in the direction of the second longitudinal side 32. In contrast to this, the two rotary brushes 14 and 15 are offset, in relation to the center axis 74, toward the first longitudinal side 31. This is evident, in particular, from FIG. 1 and from FIG. 4. They are thus at a very small distance from the first longitudinal side 31, so that, when the scrubber dryer 10 is guided along a wall, the rotary brushes 14 and 15 are only a very small distance away from this wall. The scrubber dryer 10 is thus distinguished by being able to access edges to good effect.

Impact elements in the form of deflecting rollers 76 are disposed in the region of the first longitudinal side 31 level with the front side 33 and level with the rear side 34, as seen in relation to the operating direction 19, these rollers being produced preferably from an elastomeric material and providing impact protection for the scrubber dryer 10.

In order to ensure that the transporting wheels 40 and 41 cannot be released in an unintended manner from the bearing bushings 64, the wheel bearings 61 and 62 each have a fixing device 78 with a clamping element in the form of a wire clip 79, which comprises a substantially U-shaped clamping portion 80, with a first clamping leg 81 and a second clamping leg 82, and a guide portion 84, with a first guide leg 85 and a second guide leg 86. The first guide leg 85 adjoins the free end of the first clamping leg 81, and the second guide leg 86 adjoins the free end of the second clamping leg 82. The two guide legs 85, 86 are oriented obliquely in relation to one another and each engage against a respective sliding surface 88, 89 on the appliance. The two clamping legs 81, 82 are connected to one another integrally via a crosspiece 91, which engages against a pushbutton 92. The pushbutton 92 forms an actuating element for the fixing device 78. If the user pushes the pushbutton 92, then the wire clip 79 is displaced in the direction of the two sliding surfaces 88, 89, the two guide legs 85 and 86 sliding along the respective sliding surface 88, 89 and the clamping portion 80 thus spreading apart.

The axle stubs 55 and 56 of the transporting wheels 40 and 41 each have a respective annular groove 94, 95. If the axle stubs 55, 56 are each inserted into a bearing bushing 64, then the wire clip 79 automatically snaps, by way of the two clamping legs 81, 82, into the respective annular groove 94, 95, so that the respective transporting wheel 40, 41 is retained in the bearing bushing 64 such that it cannot be displaced in the axial direction of the respective axle stub 55, 56. If, following transportation of the scrubber dryer 10, the transporting wheel 40, 41 needs to be released from the respective wheel bearing 61 or 62 again, then all that is required, for this purpose, is for the user to actuate the pushbutton 92, so that the wire clip 79 frees the respective axle stub 55, 56 and the user can remove the axle stub 55, 56 from the bearing bushing 64 without the aid of tools. The respective transporting wheel 40, 41 can then be positioned, for storage purposes, on the retaining shell 43 or 44.

The two wheel bearings 61 and 62 are positioned in the vertical direction such that the transporting wheels 40, 41, upon fixing to the respective wheel bearings 61 and 62, are disposed above the lower edge 97 of the respective rotary brushes 14 and 15 when the scrubber dryer 10 assumes its operating position, this being evident, in particular, from FIG. 4. As a result, in the operating position of the scrubber dryer 10, the transporting wheels 40, 41 cannot come into contact with the floor surface, so that they can easily be Fixed on the wheel bearings 61, 62 for the purpose of transporting the scrubber dryer 10 and can be released from the wheel bearings 61, 62 again following transportation.

The invention claimed is:

1. Floor-cleaning appliance, comprising:

a housing, at least one floor-cleaning tool disposed on an underside of the housing, the at least one floor cleaning tool adapted to be driven in rotation or oscillation, the floor-cleaning appliance, for a purpose of cleaning a floor surface, is adapted to be guided manually by a user in an operating direction along the floor surface, wheel bearings disposed laterally on the housing, and transporting wheels which are adapted to be removably fixed by the user, for a purpose of transporting the floor-cleaning appliance, on the wheel bearings, at least one storage device for holding the transporting wheels when removed from the wheel bearings, each of the at least one storage devices being configured as a wheel holder on which the transporting wheels can be retained in a non-displaceable manner, and wherein the transporting wheels each carry an axle stub, and the wheel holders each have a mount into which one of the axle stubs can be plugged.

2. Floor-cleaning appliance according to claim 1, wherein:

the floor-cleaning appliance is adapted to be transferred out of an operating position, which the appliance assumes for the purpose of cleaning the floor surface, into a transporting position, in which the floor-cleaning appliance can be transported, the transporting wheels when fixed on the wheel bearings are spaced apart from the floor surface in the operating position of the floor-cleaning appliance and in contact with the floor surface in the transporting position of the floor-cleaning appliance.

3. Floor-cleaning appliance according to claim 1, wherein:

the floor-cleaning appliance has two transporting wheels, which, for the purpose of transporting the floor-cleaning appliance, are adapted to be fixed on sides of the housing that face away from one another such that the two transporting wheels are rotatable about a common axis of rotation, and for transporting purposes, the floor-cleaning appliance is adapted to be pivoted about the common axis of rotation of the transporting wheels.

4. Floor-cleaning appliance according to claim 3, wherein the common axis of rotation of the transporting wheels is aligned parallel to the operating direction of the floor-cleaning appliance.

5. Floor-cleaning appliance according to claim 4, wherein the at least one floor-cleaning tool is offset, in relation to a center axis of the floor-cleaning appliance, in a direction away from the common axis of rotation of the transporting wheels.

6. Floor-cleaning appliance according to claim 4, wherein impact-protection elements are disposed on a side of the housing, this side being remote from the common axis of rotation of the transporting wheels.

7. Floor-cleaning appliance according to claim 1, further comprising:

a pivotable pushing frame and an arresting member, wherein the pushing frame, for the purpose of transporting the floor-cleaning appliance, is adapted to be arrested in a vertical position by means of the arresting member.

8. Floor-cleaning appliance according to claim 7, wherein the arresting member is adapted to be moved back and forth between an arresting position and a release position.

9. Floor-cleaning appliance according to claim 7, wherein the arresting member is adapted to be pivoted about a pivot axis.

10. Floor-cleaning appliance according to claim 7, wherein:

the floor-cleaning appliance has two transporting wheels, and the arresting member is disposed above a common axis of rotation of the two transporting wheels.

11. Floor-cleaning appliance according to claim 1, wherein a respective fixing device is disposed on the wheel bearings for the purpose of fixing the transporting wheels.

12. Floor-cleaning appliance according to claim 11, wherein:

the transporting wheels each carry an axle stub and the wheel bearings each comprise a bearing bushing which accommodates the axle stub, the axle stubs are adapted to be arrested in an axially non-displaceable manner in the bearing bushing by means of the fixing device.

13. Floor-cleaning appliance according to claim 12, wherein the fixing device has at least one clamping element for the purpose of arresting an axle stub in the bearing bushing.

14. Floor-cleaning appliance according to claim 13, wherein the axle stubs have an annular groove in which a clamping element engages automatically when the axle stubs are introduced into the bearing bushing.

15. Floor-cleaning appliance according to claim 13, wherein the fixing device has an actuating element for releasing the arresting of the axle stub.

16. Floor-cleaning appliance according to claim 15, wherein the actuating element is configured as a pushbutton which can be actuated to transfer the clamping element out of a clamping position into a release position.

17. Floor-cleaning appliance according to claim 1, wherein the floor-cleaning appliance comprises two storage devices that face away from one another.

18. Floor-cleaning appliance according to claim 1, wherein the floor-cleaning appliance is configured as a scrubber dryer.

19. Floor-cleaning appliance comprising:

a housing, at least one floor-cleaning tool disposed on an underside of the housing, the at least one floor cleaning tool adapted to be driven in rotation or oscillation, the floor-cleaning appliance, for a purpose of cleaning a floor surface, is adapted to be guided manually by a user in an operating direction along the floor surface, wheel bearings disposed laterally on the housing, and transporting wheels which are adapted to be removably fixed by the user, for a purpose of transporting the floor-cleaning appliance, on the wheel bearings, at least one storage device for holding the transporting wheels when removed from the wheel bearings, wherein the at least one storage device is disposed on a pushing frame of the floor-cleaning appliance at a distance from the housing.

20. Floor-cleaning appliance according to claim 19, wherein each of the at least one storage devices are configured as wheel holders on which the transporting wheels can be retained in a non-displaceable manner.

21. Floor-cleaning appliance according to claim 3, wherein:

the transporting wheels each carry an axle stub, and the wheel holders each have a mount into which an axle stub can be plugged.

22. Floor-cleaning appliance comprising:

a housing, at least one floor-cleaning tool disposed on an underside of the housing, the at least one floor cleaning tool adapted to be driven in rotation or oscillation, the floor-cleaning appliance, for a purpose of cleaning a floor surface, is adapted to be guided manually by a user in an operating direction along the floor surface, wheel bearings disposed laterally on the housing, and transporting wheels which are adapted to be removably fixed by the user, for a purpose of transporting the floor-cleaning appliance, on the wheel bearings, at least one storage device for holding the transporting wheels when removed from the wheel bearings, each of the at least one storage devices being configured as a wheel holder on which the transporting wheels can be retained in a non-displaceable manner, wherein:

the transporting wheels each carry an axle stub, the wheel holders each have a mount into which one of the axle stubs can be plugged, and the axle stubs are adapted to be clamped in the mounts.

* * * * *

UNITED STATES PATENT AND TRADEMARK OFFICE

CERTIFICATE OF CORRECTION

PATENT NO. : 8,006,341 B2
APPLICATION NO. : 12/661418
DATED : August 30, 2011
INVENTOR(S) : Merz et al.

It is certified that error appears in the above-identified patent and that said Letters Patent is hereby corrected as shown below:

Column 10, line 32, claim 6: "housing, this side being remote from the common axis of" should read
-- housing remote from the common axis of --

Column 12, line 5, claim 21: "Floor-cleaning appliance according to claim 3," should read
-- Floor-cleaning appliance according to claim 20, --

Signed and Sealed this
Twenty-ninth Day of May, 2012

David J. Kappos

David J. Kappos
*Director of the United States Patent and Trademark Office*